US009194125B1

(12) United States Patent
Romanenko

(10) Patent No.: US 9,194,125 B1
(45) Date of Patent: Nov. 24, 2015

(54) CONSTRUCTION COMPONENT HAVING EMBEDDED INTERNAL SUPPORT STRUCTURES TO PROVIDE ENHANCED STRUCTURAL REINFORCEMENT AND IMPROVED EASE OF CONSTRUCTION THEREWITH

(71) Applicant: Sergei V. Romanenko, Milford, NH (US)

(72) Inventor: Sergei V. Romanenko, Milford, NH (US)

( * ) Notice: Subject to any disclaimer, the term of this patent is extended or adjusted under 35 U.S.C. 154(b) by 0 days.

(21) Appl. No.: 14/485,618

(22) Filed: Sep. 12, 2014

(51) Int. Cl.

| | |
|---|---|
| ***E04B 1/41*** | (2006.01) |
| ***E04C 1/39*** | (2006.01) |
| ***E04B 1/04*** | (2006.01) |
| ***E04C 5/06*** | (2006.01) |

(52) U.S. Cl.
CPC . *E04C 1/39* (2013.01); *E04B 1/043* (2013.01); *E04B 1/4114* (2013.01); *E04C 5/06* (2013.01); *E04B 2103/02* (2013.01)

(58) Field of Classification Search
CPC ..... E04C 1/39; E04C 5/06; E04C 5/0627; E04C 2002/048; E04C 2002/046; E04C 2002/045; E04B 1/043; E04B 1/04; E04B 1/4114; E04B 1/215; E04B 2001/2415; E04B 2002/0254; E04B 203/021
USPC ..... 52/565, 562, 563, 600, 601, 438, 569
See application file for complete search history.

(56) References Cited

U.S. PATENT DOCUMENTS

| | | | | | |
|---|---|---|---|---|---|
| 1,779,755 | A | | 10/1930 | Smith | |
| 2,140,283 | A | * | 12/1938 | Faber | 52/378 |
| RE20,980 | E | * | 1/1939 | McMillan | 52/261 |
| 2,154,754 | A | | 4/1939 | Kemp | |
| 2,199,152 | A | * | 4/1940 | Edge et al. | 29/897.31 |
| 2,334,355 | A | | 11/1943 | Russell | |
| 2,444,133 | A | | 6/1948 | Groat | |
| 2,476,423 | A | | 7/1949 | Longenecker | |
| 2,577,323 | A | * | 12/1951 | Goenner | 52/293.3 |
| 2,920,475 | A | * | 1/1960 | Graham | 52/432 |
| 2,963,828 | A | * | 12/1960 | Belliveau | 52/564 |
| 2,969,619 | A | * | 1/1961 | Didrick | 52/601 |
| 3,296,758 | A | * | 1/1967 | Knudsen | 52/223.7 |

(Continued)

FOREIGN PATENT DOCUMENTS

| | | | | |
|---|---|---|---|---|
| EP | 0009403 B1 | | 12/1982 | |
| JP | 2003201717 A | * | 7/2003 | E02D 27/01 |

OTHER PUBLICATIONS

Website: http://www.constructionknowledge.net/masonry/masonry_masonry.php Article on masonry and construction techniques.

*Primary Examiner* — Brent W Herring

(57) ABSTRACT

A construction component provides structural reinforcement of structures built therewith, by embedding an internal support structure within a substrate component such as a cast concrete block during fabrication of the construction component. The embedded internal support structure can include interface plates that are structurally coupled to the internal support structure and are made accessible outside of the substrate to permit the internal support structures of the individual construction components to be mechanically tied together in constructing a structure therewith. The internal support structure can be triangular, and can be coupled together using threaded bolts, rivets or welds. The substrate block is formed with vertical channels to provide access to the interface plates of components being coupled during construction.

30 Claims, 10 Drawing Sheets

(56) References Cited

U.S. PATENT DOCUMENTS

| | | | | | |
|---|---|---|---|---|---|
| 3,369,334 | A | * | 2/1968 | Berg | 52/223.13 |
| 3,785,097 | A | * | 1/1974 | Seymour | 52/126.7 |
| 3,951,085 | A | | 4/1976 | Johnson et al. | |
| 3,953,948 | A | | 5/1976 | Hogan | |
| 4,080,765 | A | * | 3/1978 | Fasano | 52/223.7 |
| 4,092,810 | A | | 6/1978 | Sumner | |
| 4,121,398 | A | * | 10/1978 | Hahn et al. | 52/646 |
| 4,569,167 | A | * | 2/1986 | Staples | 52/92.2 |
| 4,625,472 | A | | 12/1986 | Busick | |
| 4,761,929 | A | * | 8/1988 | Zeigler | 52/646 |
| 5,560,167 | A | * | 10/1996 | Miceli | 52/285.4 |
| 5,862,639 | A | * | 1/1999 | Abou-Rached | 52/223.6 |
| 6,058,672 | A | * | 5/2000 | McClellan | 52/587.1 |
| 6,065,263 | A | * | 5/2000 | Taguchi | 52/583.1 |
| 6,152,797 | A | | 11/2000 | David | |
| 6,237,297 | B1 | * | 5/2001 | Paroly | 52/652.1 |
| 6,880,308 | B2 | | 4/2005 | Seiz et al. | |
| 6,915,614 | B2 | * | 7/2005 | Matsufuji | 52/600 |
| 6,935,075 | B2 | | 8/2005 | Sherman | |
| 7,597,287 | B2 | | 10/2009 | Gay | |
| 7,934,345 | B2 | * | 5/2011 | Marsh et al. | 52/223.7 |
| 8,141,320 | B2 | * | 3/2012 | Colonias | 52/699 |
| 8,419,883 | B2 | | 4/2013 | Day et al. | |
| 8,646,239 | B2 | * | 2/2014 | Rulon | 52/606 |
| 2004/0020145 | A1 | * | 2/2004 | Matsufuji | 52/223.7 |
| 2005/0252123 | A1 | * | 11/2005 | Colonias | 52/295 |
| 2007/0186502 | A1 | * | 8/2007 | Marsh et al. | 52/604 |
| 2009/0025309 | A1 | | 1/2009 | Deans et al. | |
| 2009/0100790 | A1 | * | 4/2009 | Matsufuji et al. | 52/745.19 |
| 2010/0132284 | A1 | | 6/2010 | Takeshima | |
| 2011/0283647 | A1 | * | 11/2011 | Fang | 52/565 |
| 2012/0110943 | A1 | * | 5/2012 | Ally et al. | 52/582.1 |
| 2015/0167294 | A1 | * | 6/2015 | Ally et al. | E04B 1/4128 |

* cited by examiner

CONSTRUCTION COMPONENT HAVING EMBEDDED INTERNAL SUPPORT STRUCTURES TO PROVIDE ENHANCED STRUCTURAL REINFORCEMENT AND IMPROVED EASE OF CONSTRUCTION THEREWITH

FIELD OF THE INVENTION

This application relates generally to construction components, and more particularly to construction components that are structurally enhanced internally.

BACKGROUND OF THE INVENTION

Pre-manufactured cast concrete blocks of various designs have been used in the construction industry for many years. One commonly employed concrete block design is often referred to as a CMU (Concrete Masonry Unit). Typically, a bed of mortar is manually applied over the blocks, which are then hand set and aligned into the mortar in a staggered fashion to create mortar joints therebetween. The construction is therefore highly labor intensive. The CMU is sized to balance ease in handling and the ability to construct walls of various shapes, with being large enough to reduce the total number of manual operations required in constructing those walls. While the size of a CMU varies internationally, the most common nominal size is 16 inches×8 inches×8 inches (about 410 mm×200 mm×200 mm).

Because concrete is strong in compression, but relatively weak in tension, concrete is often structurally reinforced to compensate for this structural imbalance. Thus, CMUs are typically made with hollow channels, sometimes referred to as voids or cores, that permit the deployment of steel rebar (reinforcement bar) there through. Because the blocks are staggered, the channels or voids overlap from one layer to another, permitting rebar to extend from the top of the wall to the bottom. The rebar is typically secured within the voids using grout or concrete.

While this technique of reinforcement can be effective to internally reinforce a constructed wall, the reinforcement process, when combined with the process of actually laying the blocks is highly labor intensive, time consuming, and therefore costly. Furthermore, variations in environmental conditions as well as the skill of the masons during construction, can lead to inconsistencies in the quality of a completed wall.

In an attempt to lower the cost of construction, the construction industry has also employed building blocks that are much larger in size than the CMU. However, as the size of concrete blocks increase, they have tendency to become brittle, thereby necessitating reinforcement. To further reduce construction costs, the larger prefabricated blocks are sometimes pre-fabricated with internal reinforcement materials already built into the block during fabrication. Not only does this render the pre-reinforced blocks more difficult to handle and transport, but the reinforcement materials are neither interconnected, nor are they directly coupled to external structures used to create overall stability of the walls. This lack of integration can result in overuse of such reinforcement material to achieve a wall of a desired strength.

It should be further pointed out that while the geometry of CMUs and other concrete blocks is favorable for providing reinforcement in vertical and horizontal planes, walls constructed of such blocks still tend to have low resistance to sheer stress, which makes them less than ideal for seismically-resistant construction.

SUMMARY OF THE INVENTION

The construction component of the present invention provides structural reinforcement of structures built therewith, by including an internal support structure that is embedded within a substrate component such as a cast concrete block, during fabrication of the construction component. The component can include interface plates that are structurally coupled to the internal support structure to permit the internal support structures of the individual construction components to be mechanically tied together in constructing a structure therewith. Thus, the internal support structures of the individual components can be coupled together without the need for labor intensive and inconsistent conventional mortar joints, as well as to provide an interconnected lattice of internal reinforcement throughout the structure that eliminates the need to add what is otherwise an inferior form of structural reinforcement conventionally added to the structure on site.

An embodiment of a construction component of the invention provides internal structural reinforcement embedded during its fabrication. The internal structural reinforcement is configured to be directly coupled to the embedded internal reinforcement of others of the construction component the construction component. The internal support structure includes at least one triangular structure, with the at least one triangular structure being formed of a base member and two congruent side members. The members of the triangular shaped structure form a first base vertex between a first one of the congruent members and the base member, a second base vertex between the second congruent member and the base member, and an elevated vertex formed by the first and second congruent members opposite of the base member. The internal support structure also includes at least one elevated interface plate that is structurally coupled to the congruent members at the elevated vertex, and a first and second base interface plate, with the first base interface plate being coupled to the first one of the congruent members and the base member at the first base vertex and the second base interface plate being coupled to the second one of the congruent members and the base member at the second base vertex. The construction component further includes a cast concrete block substantially surrounding the internal support structure, with the elevated interface plate of the internal support structure being exposed through a top surface of the concrete block, the first and second base interface plates being exposed through a bottom surface of the concrete block. The elevated interface plates of the construction component is configured to be mechanically coupled to one of the base interface plates of each of at least two others of the construction components to securely couple the construction components together in a staggered manner.

In an embodiment, the congruent members and base member of the at least one triangular structure are composed of steel rebar.

In a further embodiment, the at least one triangular structure is composed of a unitary piece of pressed metal. In other embodiments, the base interface plates are bent to form right angles to the two congruent and base members respectively.

In further embodiments the cast concrete block includes at least a first and second vertical channel, each extending from the top surface to the bottom surface of the concrete block, and disposed over the base interface plates to provide access to the base interface plates from the top surface.

In a further embodiment, the base interface plates include at least one opening therethrough, each of the vertical channels disposed directly over the at least one opening of each of the base interface plates. The upper interface plate includes at least two threaded openings, wherein the at least one opening of each of the base interface plates of a first one of said construction components is configured to be aligned with at least one of the at least two threaded openings of the elevated interface plate of a second one of said construction components such that a threaded bolt can be inserted through the at least one opening of the base interface plate and screwed into the at least one of the at least two threaded bolts to mechanically couple the first one and second one of the construction components together.

In further embodiments, a third one of the construction components can be coupled in a staggered manner to the second one of the construction components along with the first one of the construction components by screwing a threaded bolt through the at least one opening of the third one of the construction components into a remaining at least one of the at least two threaded openings of the elevated interface plate of the second one of the construction components.

In still further embodiments, the construction components can be mechanically coupled to a second one of the interface components by riveting the base plate of the first construction component to the elevated interface plate of the second interface component through the vertical channel of the first construction component.

In other embodiments, a first one of the construction components can be mechanically coupled to a second one of the interface components by welding the base plate of the first construction component to the elevated interface plate of the second interface component through the vertical channel of the first construction component.

In an embodiment, the first and second base plates are formed a single L-shaped bar. In other embodiments, the internal support structure includes two of the triangular structures disposed substantially in parallel with one another, and the concrete block includes at least a first and second vertical channel disposed over the base interface plates of each of the two triangular structures. In a further embodiment, the first and second base plates of each of the two triangular structures are formed of a single U-shaped bar.

In another embodiment, the internal support structure includes two or more instantiations of the two triangular structures disposed in parallel, each of the instantiations including additional members that are coupled between the elevated interface plates of the two or instantiations.

In further embodiments, the at least one triangular structure further includes a vertical member extending from the upper vertex to a point on the base member that is substantially half way between the two base vertices, and a support plate that is structurally coupled to the triangular structure at a point beneath the intersection between the vertical member and the base member.

In an alternate embodiment, the internal support structure further includes one or more additional members that are cross-coupled between the base vertices of the two triangular structures. The internal support structure can further include one or more additional members that are cross-coupled between the elevated vertex of at least one of the two triangular structures to at least one of the base vertices of the other of the two triangular structures of the internal support structure.

In one embodiment, the cast concrete block has the dimensions of a CMU (concrete masonry unit).

In further embodiments, building a structure from a plurality of the construction components creates an interconnected internal support structure lattice throughout the structure.

In other aspects of the invention, a construction component of invention includes an internal support structure that includes at least two triangular structures, each being formed of a base member and two congruent side members to establish a first base vertex between a first one of the congruent members and the base member, a second base vertex between the second congruent member and the base member, an elevated vertex formed by the first and second congruent members opposite of the base member. The internal support structure further includes at least one member cross-coupled between a first and second one of the at least two triangular structures. The internal support structure further includes at least one elevated interface plate being structurally coupled substantially at the elevated vertex of each of the at least two triangular structures, as well as at least one first and at least one second base interface plate, the at least one first base interface plate being coupled substantially at the first base vertex of each of the at least two triangular structures, and the at least one second base interface plate being coupled substantially at the second base vertex of each of the at least two triangular structures.

The construction component of the invention further includes a cast concrete block substantially encapsulating the internal support structure therein, the at least one elevated interface plate of the internal support structure being exposed through a top surface of the concrete block, the at least one first and at least one second base interface plates being exposed through a bottom surface of the concrete block. The at least one elevated interface plate of said construction component is configured to be mechanically coupled to one of the at least one first and second base interface plates of each of at least two others of said construction component to securely couple said construction components together in a staggered manner.

In a further embodiment, the first and second of the at least two triangular structures are disposed in planes that are substantially in parallel with one another.

In other embodiments, wherein the first and second of the at least two triangular structures are isosceles triangles.

In still further embodiments, the at least one cross-coupled member is coupled substantially between the vertex of each of the first and second of the at least two triangular structures.

In other embodiments, the cross-coupled member is coupled substantially between the vertex of the first of the at least two triangular structures and at least one of the two base vertices of the second of the at least two triangular structures.

In another embodiment, the at least one cross-coupled member is coupled substantially between at least one of the base vertices of the first of the at least two triangular structures, and at least one of the two base vertices of the second of the at least two triangular structures.

In other aspects of the construction component of the invention, the concrete block includes a thermally resistant layer that substantially divides the concrete block into at least two substantially discrete concrete sections, and the first and second of the at least two triangular structures are each encapsulated within a different one of the concrete sections.

In other embodiments, the at least one cross-coupled member is coupled substantially between the first congruent members of each of the first and second of the at least two triangular structures to provide cross-coupling between the upper vertices and the first base vertices of the first and second triangular structures.

In still further embodiments, the at least one cross-coupled further provides cross-coupling between each of the upper vertices one of the first and second triangular structures, and the each of the first base vertices of the other respectively.

In a further embodiment, the at least one cross-coupled member spans the thermally resistant layer of the block between the first and second of the at least two triangular structures.

In other embodiments, the base member and two congruent side members of the first and second of the at least two triangular structures are made of thermally conductive metal, and the cross-coupled member is made of a thermally resistant material.

BRIEF DESCRIPTION OF THE DRAWINGS

The following description can be better understood in light of Figures, in which.

DETAILED DESCRIPTION

Various embodiments of a construction component are disclosed that are internally reinforced with triangular reinforcing structures during their fabrication, and are capable of being bolted together in lieu of employing conventional techniques such as creating mortar joints. Because the construction component of the invention can be pre-fabricated with the internal triangular reinforcement structure incorporated, no additional reinforcement need be undertaken on site during construction of walls made therewith. The triangular internal reinforcement structure includes interface plates, located at the vertices of the triangular structure, by which to mechanically couple the triangular reinforcement structures to the internal triangular reinforcement structures of adjacent and overlapping building components in the form of a lattice. It is this ability to mechanically interconnect the internal triangular reinforcement structures of all of the building components within a structure constructed therewith, which eliminates the labor intensive procedures as discussed above that are required when using conventional constructional components.

Figure 1:
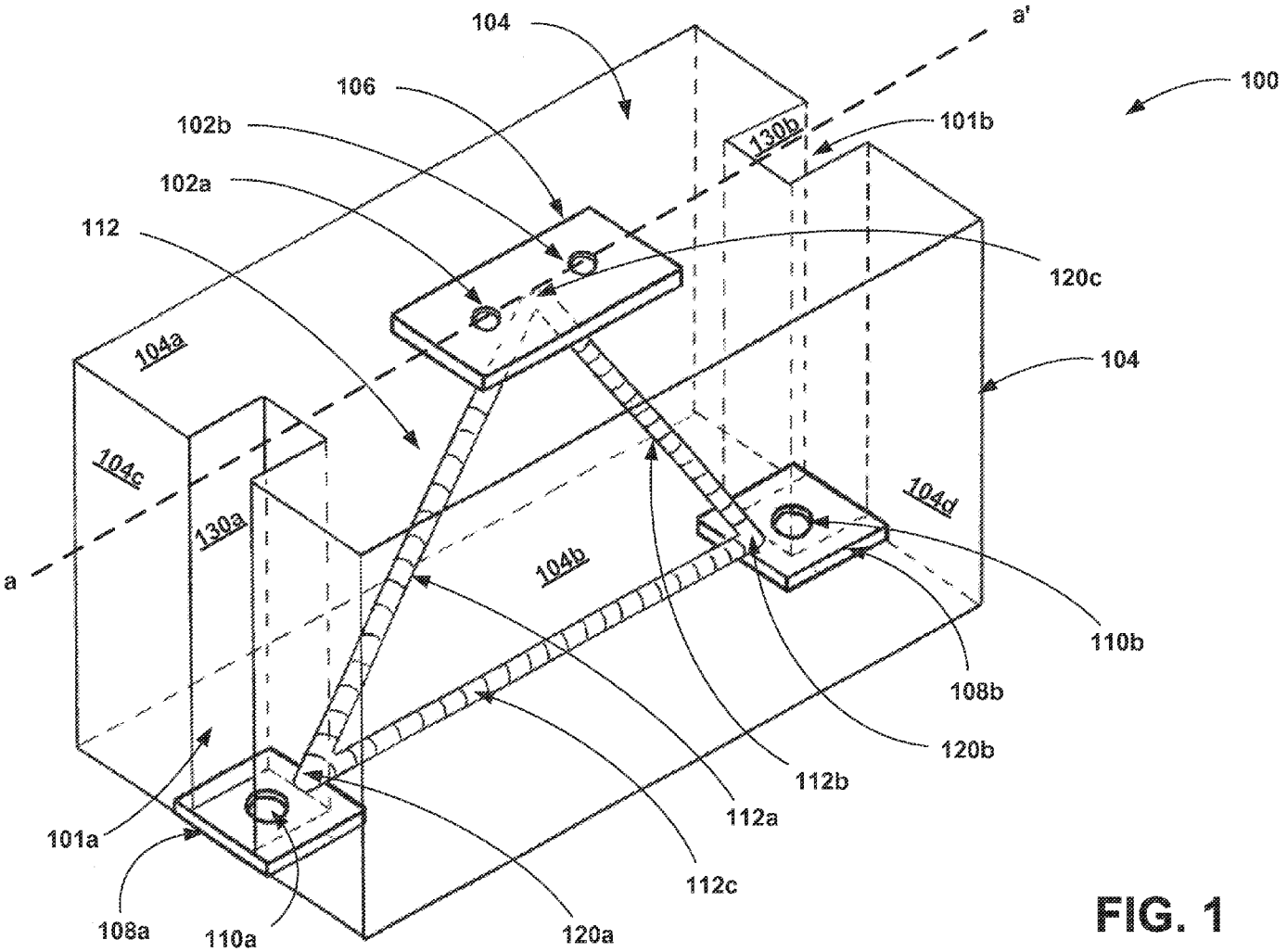
FIG. 1 illustrates perspective view of an embodiment of the construction component of the invention with a load bearing triangular reinforcement structure disposed therein.

FIG. 1 illustrates a perspective view of an embodiment 100 of a construction component of the invention, having an internal load bearing triangular reinforcement structure 112 disposed therein. The construction component 100 can be constructed of, for example, cast concrete and can be cast to assume the form of a building block 104. Block 104 can be made with dimensions such as those of a conventional CMU, or any other dimensions and geometric forms suitable for a particular construction application. The internal load bearing triangular structure 112 can be formed of any suitable material that is capable of providing the required structural support and coefficient of thermal expansion consistent with the material forming the cast block. As previously discussed above, ribbed steel rebar and concrete have very similar thermal expansion properties and are therefore a good combination. The embedded internal support structure 112 and can be cast within the block 104 by aligning it within a cast mold of the block before pouring the concrete into the mold. Embedded internal support structure 112 can be held in place during the casting process by, for example, by bolting it to the bottom of the cast mold.

The three members 112*a*, 112*b* and 112*c* of the internal support structure 112 can be dimensioned to form an isosceles triangle. The internal support structure 112 can be constructed of a single integral piece of metal, or may be constructed of separate members that are structurally fused using an appropriate technique such as welding. The structure further includes three interface plates 106, 108*a* and 108*b*, to which the members 112*a*, 112*b* and 112*c* are coupled at or near their vertices. The interface plates 106, 108*a* and 108*b* can be formed integrally with members 112*a*, 112*b* and 112*c*, or they can be structurally joined such as by a welding process.

In an embodiment, the base member 112*c* of the isosceles triangle forming internal support structure 112 is disposed substantially proximate to, and parallel with, the base surface 104*b* of concrete block 104. Base interface plates 108*a* and 108*b* are disposed in parallel with and substantially on top of the base surface 104*b*. The bottom surface of base interface plates 108*a* and 108*b* can be exposed through the base surface 104*b* of concrete block 104. In an embodiment, the base vertices 120*a* and 120*b* of internal support structure 112 are each coupled to the top surface of the two base plates 108*a* and 108*b* respectively.

In an embodiment, each of base interface plates 108*a* and 108*b* have openings 110*a* and 110*b* respectively disposed through them, each for receiving a threaded coupling bolt (not shown) in FIG. 1. Openings 110*a* and 110*b* can be made accessible from the top via vertical channels 101*a* and one 101*b* respectively, which can be cast into end surfaces 104*c* and 104*d* of concrete block 104 respectively. The width and depth of vertical channels 101*a* and 101*b* can be dimensioned to be smaller than base interface plates 108*a* and 108*b* to ensure that sufficient cast concrete overlaps the base interface plates, thereby fixedly holding them and the triangular support structure 112 within the cast concrete. The openings 110*a* and 110*b* are also preferably exposed through base surface 104*b*.

Internal support structure 112 is oriented with block 104 such that top vertex 120*c*, formed by the two congruent sides 112*a* and 112*b* of isosceles of the triangular support structure 112, is located at or substantially near the top surface 104*a* of concrete block 104, and is coupled to upper interface plate 106. The top surface of upper interface plate 106 lies in a plane that is parallel with the top surface 104*a* of block 104, and can be exposed through the top surface 104*a*. Upper interface plate 106 can be about twice the length of the base interface plates 108*a* and 108*b*, and has two threaded openings 102*a* and 102*b* disposed through it. The openings 102*a* and 102*b* are exposed and accessible to receive threaded bolts (not shown) through top surface 104*a*.

Figure 2:
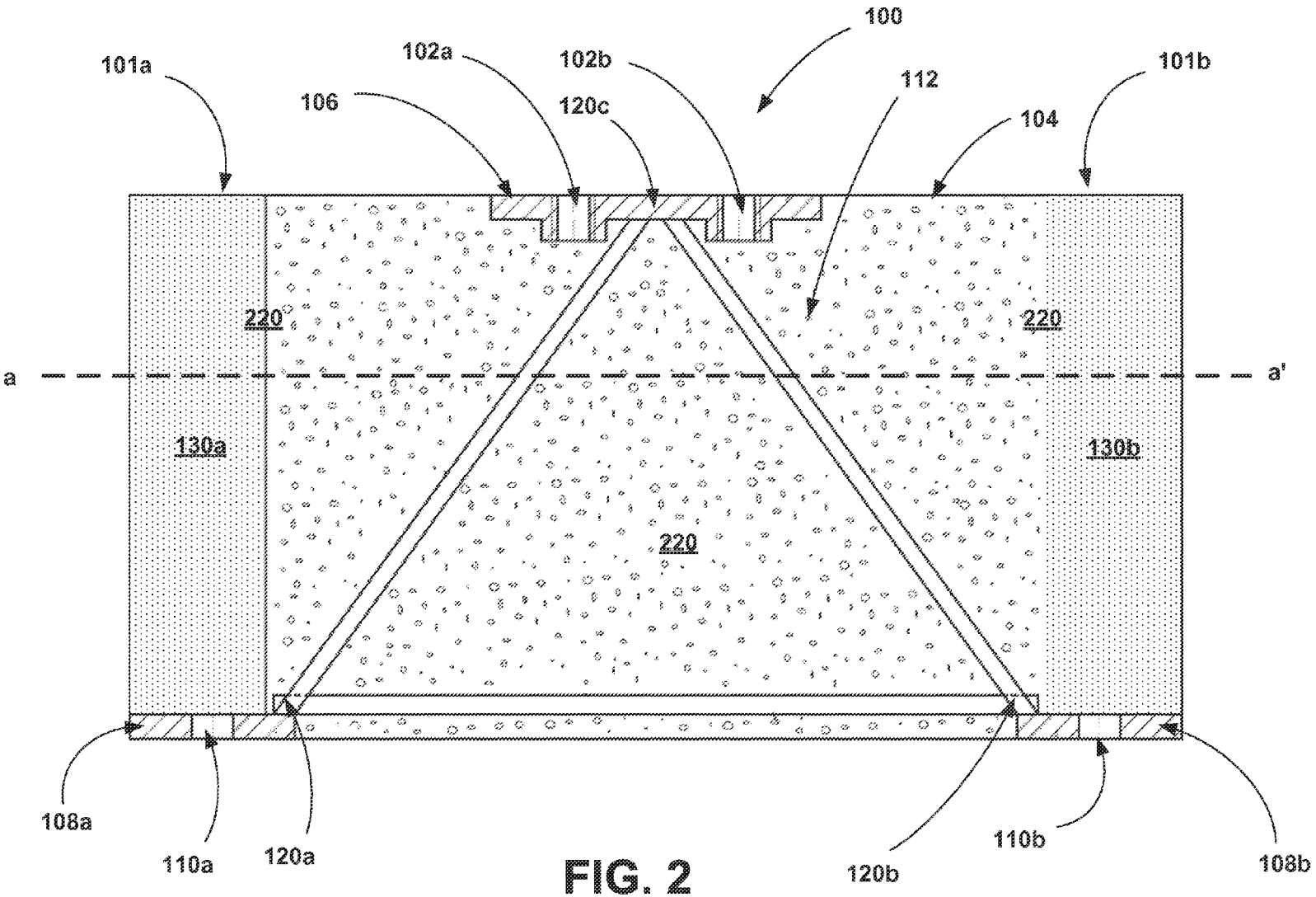
FIG. 2 illustrates a cross-sectional view of the embodiment of the construction component of the invention as shown in FIG. 1.

FIG. 2 illustrates a cross-sectional view of the embodiment 100 of the construction component of the invention as illustrated in FIG. 1, taken along line a-a'. As can be seen from FIG. 2, upper interface plate 106 can be structurally fused to the vertex 120*c* of triangular shaped internal support structure 112 and is exposed through the top surface 104*a* of block 104. Single base interface plates 108*a* and 108*b* are structurally fused to triangular structure 112 at base vertices 120*a* and 120*b* respectively, each being disposed at the bottom of block 104 and exposed through bottom surface 104*b*. Threaded holes 102*a* and 102*b* are formed in upper interface plate 106, having a suitable diameter and a length suitable for ensuring sufficient coupling strength between plate 106 and threaded bolts (not shown), used to couple block 104 to the single base interface plates 108*a* and 108*b* of other like components, placed in a staggered relationship therewith (See FIG. 3).

As can be seen, triangular shaped internal support structure 112 can be, except for the bottom surfaces of its interface plates, completely encapsulated and fixed within block 104 by cast concrete 220. Internal surface 130*a* and 130*b* of vertical channels 101*a* and 101*b* respectively are illustrated with a different shading to indicate that they are not in the same plane as cross-sectional axis a-a'. The vertical channels 101*a* and 101*b* overlap the single interface plates on three sides to hold the single interface plates in place, but are open at each end of block 104 to permit access to the openings 110*a* and 110*b* for purposes of coupling the components 100 together from above.

Figure 3:
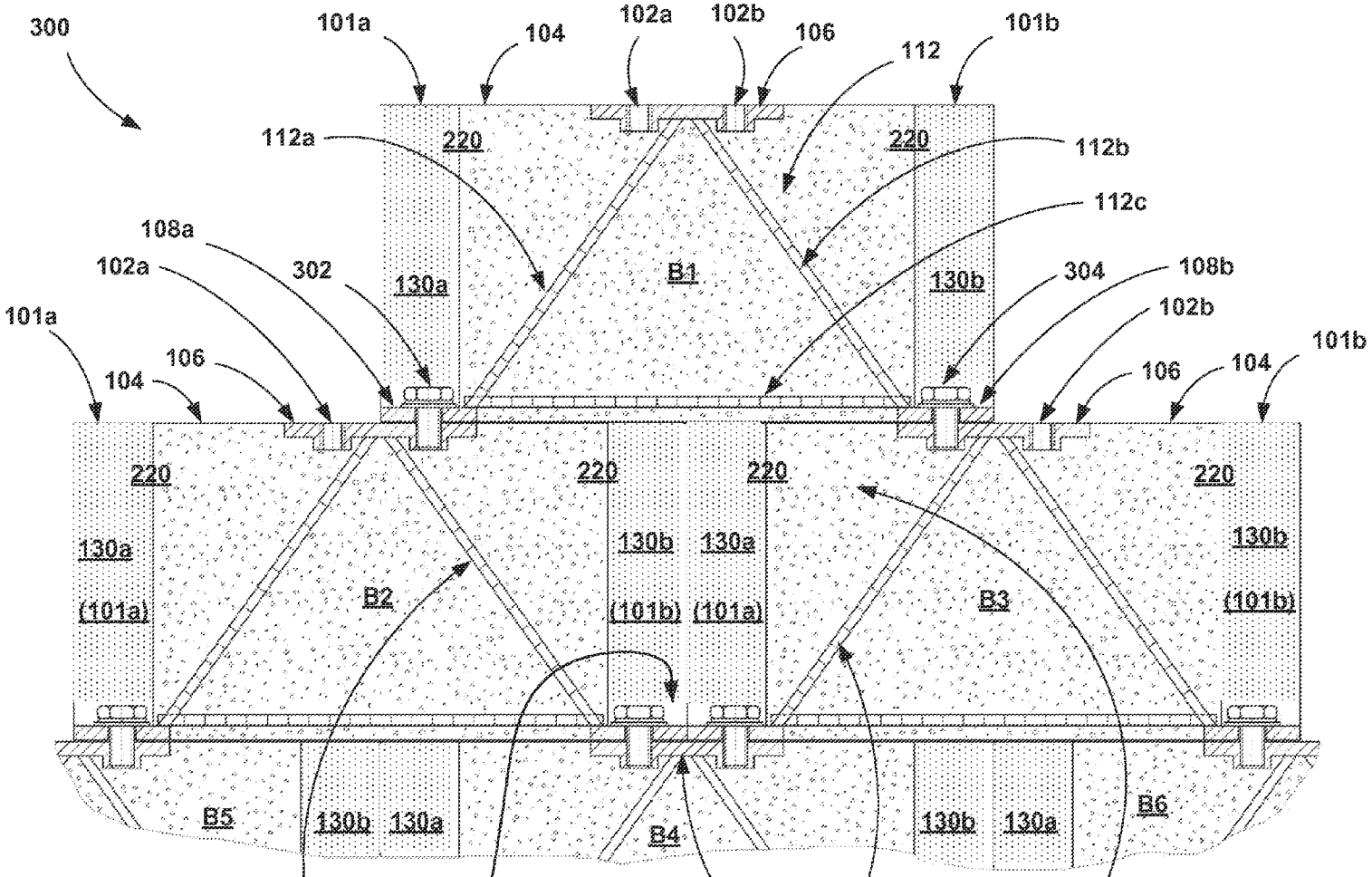
FIG. 3 illustrates a cross-sectional view of a portion of a wall constructed using the embodiment of the construction component of the invention as illustrated in FIG. 1 and FIG. 2 to create a support lattice between the components.

FIG. 3 illustrates a portion of a wall 300 that has been constructed using the building components 100 of the invention. The view of wall 300 is of the same cross-sectional view as that of the building component 100 as illustrated in FIG. 2. As will be evident to those of skill in the art, each row of the building components 100 are staggered just as when employing conventional CMUs built with mortar joints. The right-most side (as viewed) of the upper interface plate 106 of building component B2 can be coupled to the single base plate 108*a* of building component B1, by using access provided through vertical channel 101*a* of component B1 to insert threaded bolt 302 through opening 110*a* of single base plate 108*a* of component B1, and screwing it into threaded opening 102*b* of upper interface plate 106 of component B2.

Likewise, the left-most side (as viewed) of the upper interface plate 106 of component B3 can be coupled to the single base plate 108*b* of component B1, by using access provided through vertical channel 101*b* of component B1 to insert threaded bolt 304 through opening 110*b* of single base plate 108*b* of block B1, and screwing it into threaded opening 102*a* of upper interface plate 106 of component B3.

Upper interface plate 106 of building component B4 (only partially shown) is similarly coupled to the single base interface plates 108*b* of building component B2 and single base interface plate 108*a* of building component B3. Vertical channels 101*b* and 101*a* of components B2 and B3 are ultimately covered by component B1. Those of skill in the art will appreciate that all of the internal triangularly shaped support structures 112 are interconnected much like a crystalline lattice. The interconnected internal support structures 112 also form shared inverted isosceles triangular support structures, such as inverted triangle 310, which shares a vertex 306 with component B4, and is formed by triangle member 112*b* of the embedded internal support structure 112 of component B2, member 112*a* of the internal support structure 112 of component B3, and base member 112*c* of the internal support structure 112 of component B1.

Based on the foregoing, those of skill in the art will appreciate that in addition to the benefit of eliminating onsite performance of labor intensive steps such as joining the components with mortar joints and performing conventional on site structural reinforcement as described above, the construction component of the invention produces structural reinforcement that is superior to that of conventional steel rebar reinforcement and grout that simply runs vertically through the aligned channels of conventional concrete blocks such as CMUs. The construction component of the invention 100 provides a ratio of structural strength to the amount of reinforcement material (e.g. steel rebar) used is significantly greater than that of conventional reinforcement techniques.

It will further be appreciated that while the embodiments illustrated in FIG. 1 through FIG. 3 employ threaded bolts by which to couple the interface plates of the adjoining components of the invention, other suitable means for coupling the components may be employed without exceeding the intended scope of the invention. For example, riveting techniques could be employed, or self-locking fasteners. It will be appreciated that employing bolts permits a structure to be easily disassembled, so that the components can be re-used. Conventional construction requires that a structure such as a wall be destroyed through such techniques such as wrecking balls or dynamite. These techniques typically damage or destroy the majority of the building components, preventing them from being fully redeployed.

Figure 4:
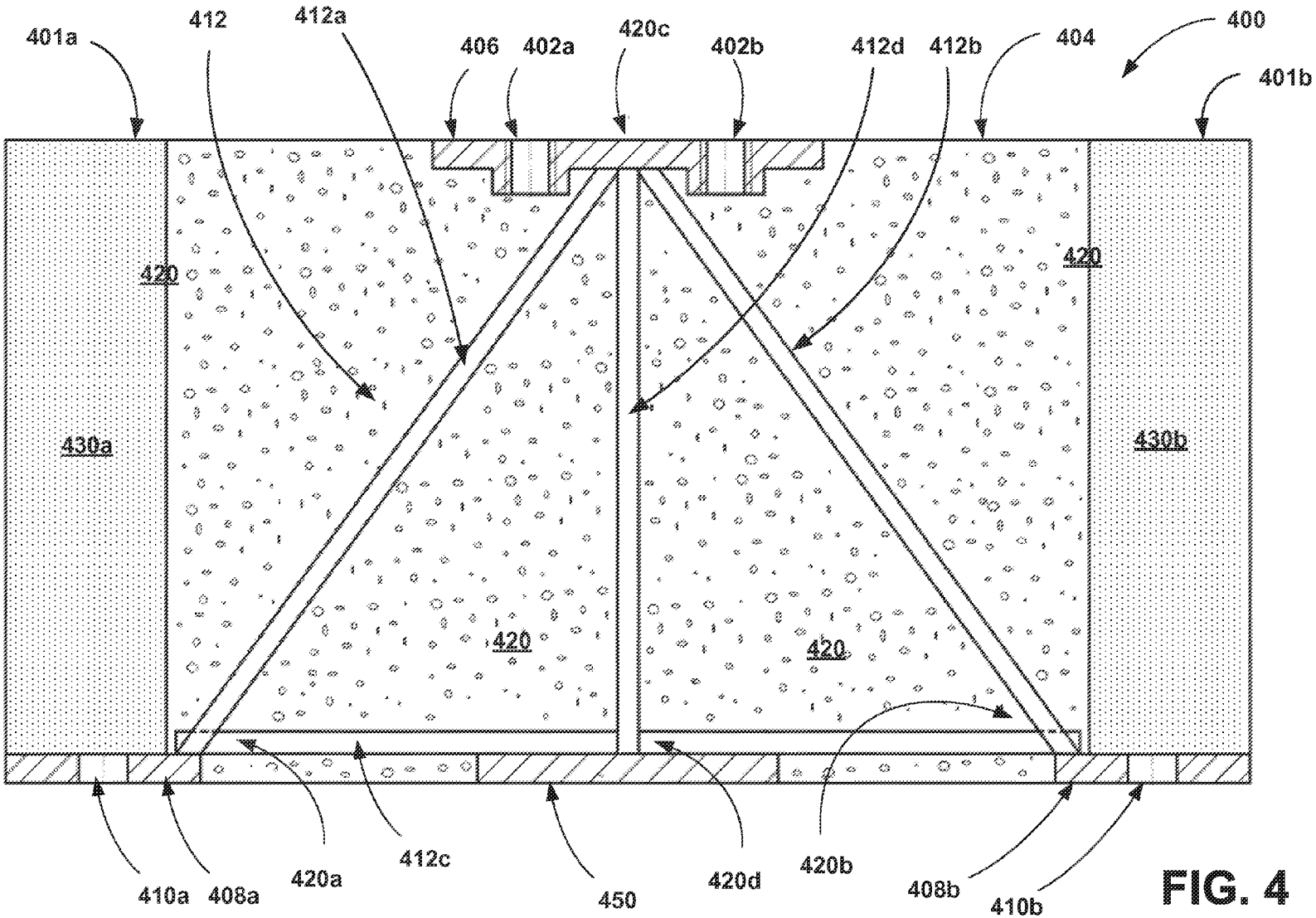
FIG. 4 illustrates a cross-sectional view an embodiment of the construction component of the invention having an additional vertical support member and middle plate.

FIG. 4 illustrates a cross-sectional view of an embodiment 400 of the construction component of the invention similar to that of FIG. 2, except that the isosceles triangular shaped internal support structure 112 includes a fourth vertical member 412*d*, in addition to triangle base member 412*c* and congruent members 412*a* and 412*b*. Vertical member 412*d* can substantially bisect the isosceles triangle formed by members 412*a*, 412*b* and 412*c*, structurally fused with congruent members 412*a* and 412*b* at vertex 420*c*. Vertical member 412*d* can extend to and be structurally fused with the base member 412*c*, at a point approximately half way between vertices 420*a* and 420*b*. Vertical member 412*d* can also be structurally fused with a support plate 450, which is disposed at, and can be exposed through, the bottom surface 404*b* of block 404.

Like the embodiments of FIG. 1 through FIG. 3, embodiment 400 is preferably made of cast concrete 420 that encases internal support structure 412. Support structure 412 has an upper interface plate 406 structurally fused with congruent members 412*a* and 412*b* at vertex 420*c*. Upper interface plate 406 has threaded openings 402*a* and 402*b* therein for receiving threaded bolts (not shown). Single interface base plate 408*a* is structurally fused with members 412*a* and 412*c* at base vertex 420*a* and single interface base plate 408*b* is structurally fused with members 412*b* and 412*c* at base vertex 420*b*. Base interface plates 408*a* and 408*b* include openings 410*a* and 410*b* respectively, therethrough. Embodiment would be assembled into a wall in the same manner as that illustrated in FIG. 3, including accessing the interface plates for inserting and screwing in bolts (not shown) through vertical channels 401*a* and 401*b*. It will be appreciated by those of skill in the art that the additional vertical member 412*d* and support plate 450 provide additional structural support against compression.

Figure 5A:
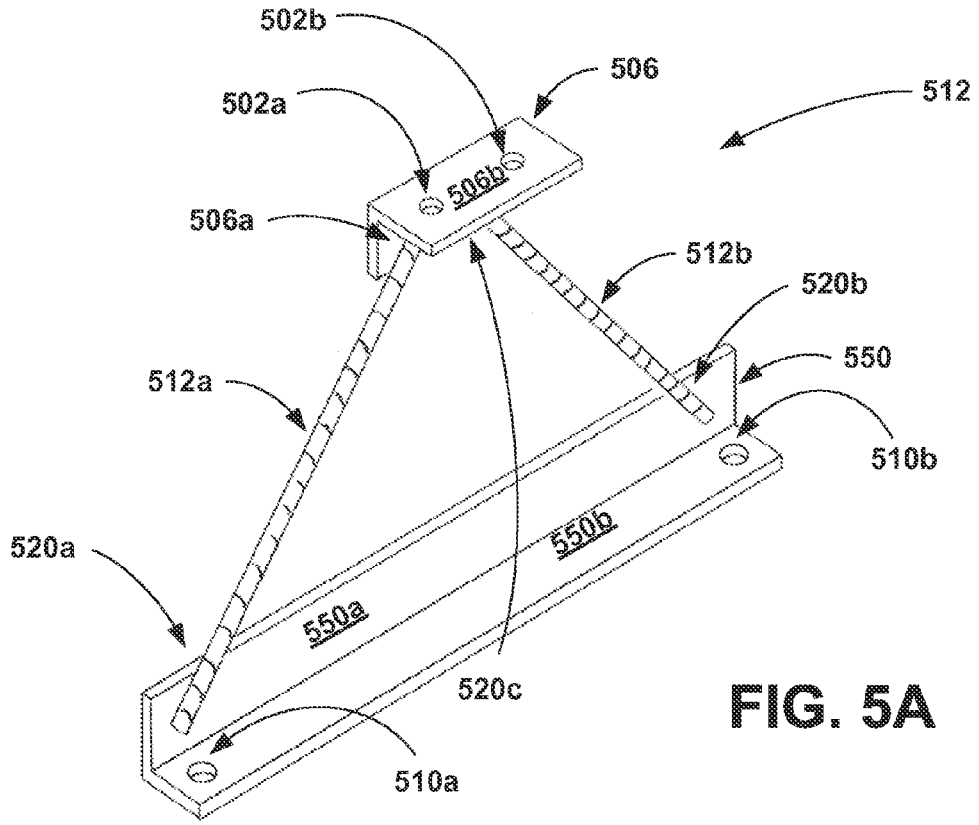
FIG. 5A illustrates a perspective view of an embodiment of the construction component of the invention having an L-shaped bar forming its base.

FIG. 5A illustrates a perspective view of an embodiment 512 of the internal support structure of the construction component of the invention, that employs a commercially available L-shaped bar 550 to serve the purpose of both the base member of the isosceles triangle of the support structure 512, as well as the base interface plates of earlier presented embodiments. Congruent members 512*a* and 512*b* are structurally fused at base vertices 520*a* and 520*b* respectively, to the inside of face of vertical segment 550*a* of the L-shaped bar. Openings 510*a* and 510*b* are disposed through the horizontal face 550*b* of the L-shaped bar 550.

The opposite ends of congruent members 512*a* and 512*b* can be structurally fused to upper interface plate 506 individually, or first to one another, and then to interface plate 506 (not shown), to establish vertex 520*c*. They can be structurally fused to the inside face of vertical segment 506*a*, to the bottom face of horizontal segment 506*b*, or both. Upper interface plate 506 includes two threaded openings 502*a* and 502*b* by which to receive and secure threaded bolts in the same manner as previously illustrated. In the embodiment of FIG. 5A, the upper interface plate can also be L-shaped, with the threaded openings disposed in the horizontal segment 506*b* and the congruent members structurally fused to the horizontal face 550*a*.

Those of skill in the art will appreciate that construction components of the invention can be constructed with support structure 512 in the same manner as embodiments previously disclosed, by disposing the support structure 512 within a casting mold and pouring concrete therein to create a cast concrete block with support structure 512 nearly completely encapsulated by concrete. The top surface (along with threaded openings 502*a* and 502*b*) of horizontal segment 506*b* of upper interface plate 506 will be exposed at the top surface of the cast concrete block, and the bottom surface of horizontal segment 550*b* of L-shaped bar 550 will be exposed at the bottom of the concrete block. Openings 510*a* and 510*b* are also made accessible from the top by forming vertical channels as part of the casting process (as described above for previously disclosed embodiments), to permit the insertion of threaded bolts through the openings 510*a* and 510*b*, and into threaded openings 502*a* and/or 502*b* of the upper interface plates 506 of like staggered components as illustrated by previously disclosed embodiments.

As previously discussed, the L-shaped bar 550 and the upper interface plate 506 can be any suitable material that provides the desired structural support, but is preferably a metal such as steel. Likewise, congruent members 512*a* and 512*b* are preferably metal rebar of a diameter that meets the desired strength of support. Also as previously discussed, techniques for fastening the interface plates of the staggered blocks other than threaded bolts may be used when constructing structures using the building components of the invention, provided those techniques ensure the requisite coupling strength.

Figure 5B:
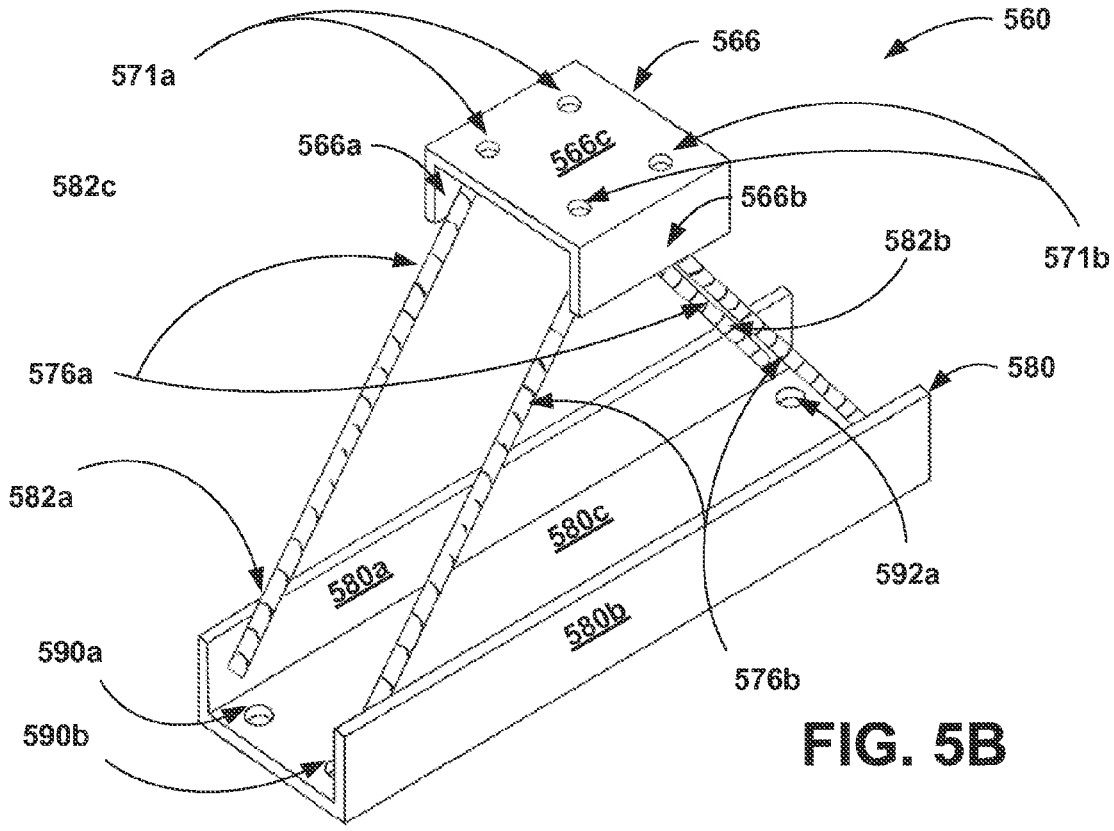
FIG. 5B illustrates a perspective view of an embodiment of the construction component of the invention having a double triangular internal support structure having a single U-shaped bar as its base.

FIG. 5B is a perspective view that illustrates an embodiment 560 of the internal support structure of a construction component of the invention that employs a commercially available U-shaped bar 580 as a common base member and base interface plate for two isosceles triangles. Congruent members 576*a* of the first triangle are structurally fused to the inside face of vertical segment 580*a* of U shaped bar 580 at base vertices 582*a* and 582*b*. The opposite ends of congruent members 576*a* are structurally fused to the inside face of vertical segment 566*a* of inverted U shaped interface plate 566, to the lower surface (not shown) of horizontal face 566*c* or both.

The congruent members 576*b* forming the second isosceles triangle are structurally fused to the inside surface (not shown) of vertical segment 580*b* of U shaped bar 580. Likewise, the opposite ends of congruent members 576*b* are structurally fused to the inside face of vertical segment 566*b* of inverted U shaped interface plate 566. U shaped bar 580 can have two openings 590*a*, 590*b* and 592*a*, 592*b* (obscured in FIG. 5B) at each end. Likewise, inverted U shaped interface plate 566 has two corresponding pairs of threaded openings 571*a* and 571*b*, for receiving threaded bolts used for coupling staggered components.

Those of skill in the art will appreciate that construction components of the invention can be constructed with support structure 560 in the same manner as embodiments previously disclosed, by disposing the support structure 560 within a casting mold and pouring concrete therein to create a cast concrete block such that support structure 560 is nearly completely encapsulated by concrete. The top surface of the horizontal segment 566*c* (as well as threaded openings 571*a* and 571*b*) of inverted U shaped interface plate 566, will be exposed at the top surface of the cast concrete block. Likewise, the bottom surface of the horizontal segment 580*c* of U-shaped bar 580 will be exposed at the bottom of the concrete block. Openings 590*a, b* and 592*a, b* are also made accessible from the top by forming vertical channels as part of the casting process (as described above for previously disclosed embodiments), to permit the insertion of threaded bolts through the openings 590*a, b* and 592*a, b* and into threaded openings 571*a* and/or 571*b* of the upper interface plates 566 of like staggered components as illustrated for previously disclosed embodiments. One vertical channel can be cast for each pair of the openings, or two vertical channels can be cast for each one of the pair.

It will be appreciated by those of skill in the art that by doubling the number of triangular support structures, as well as widening the interface plates and increasing the number of coupling points between the interface plates, even greater reinforced structural support and stability can be achieved within a building component, as well as throughout a structure built with such components.

Figure 6A:
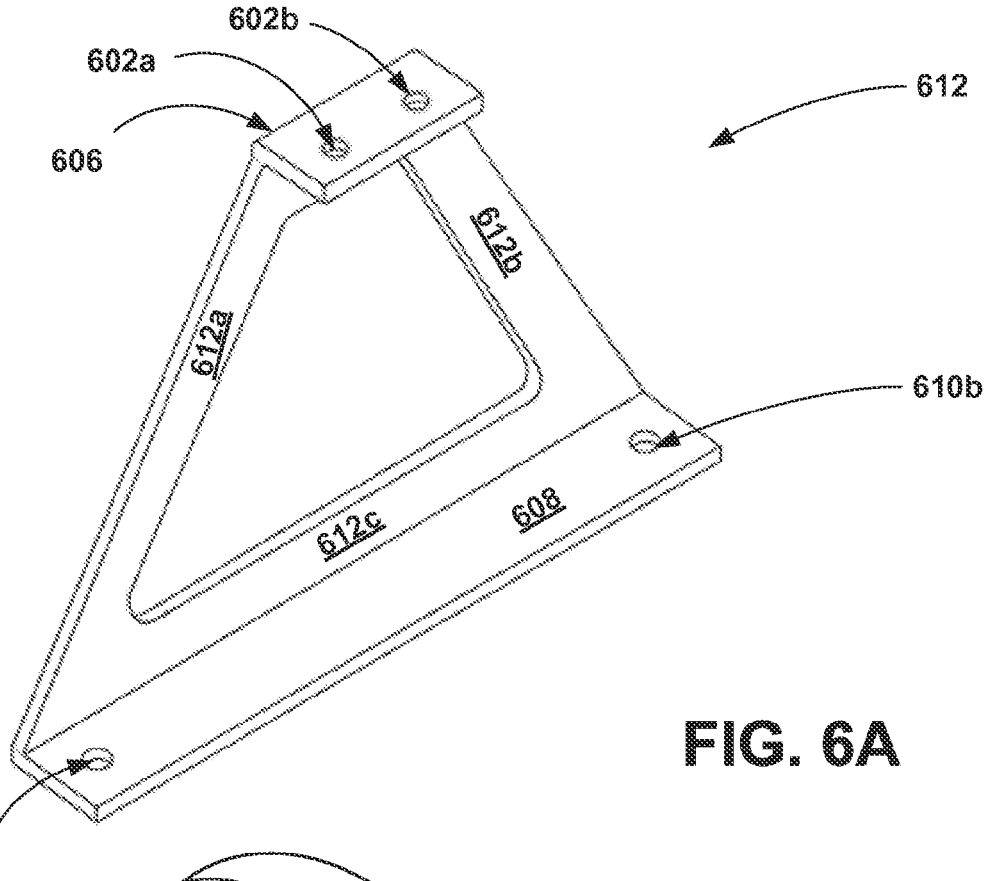
FIGS. 6A and 6B illustrate a perspective view of the embodiments of the construction component of the invention generally shown in FIGS. 5A and 5B respectively, but each made of a single unitary piece of metal.

FIG. 6A illustrates a perspective view of an embodiment 612 of the internal support structure of the construction component of the invention. Internal support structure 612 is similar to the embodiment 512 of FIG. 5A, but is constructed such that the isosceles triangle and its interface plates are of a unitary piece, such as pressed metal, and bending the metal to form the horizontal segments of the interface plates 606 and 608. Segments 612*a*, 612*b* and 612*c* form the members of the isosceles triangle shape, while bent segments 606 and 608 form the upper interface plate and the base interface plates respectively. Threaded openings 602*a* and 602*b* are configured to receive threaded bolts in the same manner as previously disclosed embodiments, and openings 610*a* and 610*b* are configured to receive threaded bolts as previously disclosed by which to secure staggered components together as previously disclosed.

Those of skill in the art will appreciate that construction components of the invention can be constructed with support structure 612 in the same manner as embodiments previously disclosed, by disposing the support structure 612 within a casting mold and pouring concrete therein to create a cast concrete block such that support structure 612 is nearly completely encapsulated by concrete. The top surface of the bent interface plate 606, will be exposed at the top surface of the cast concrete block. Likewise, the bottom surface of the bent base interface plate will be exposed at the bottom of the concrete block. Openings 610*a* and 610*b* are also made accessible from the top of the construction component by forming vertical channels as part of the casting process (as described above for previously disclosed embodiments), to permit the insertion of threaded bolts through the openings 610*a* and 610*b* and into threaded openings 602*a* and 602*b* of the upper interface plate 606 of like staggered components as illustrated by previously disclosed embodiments.

Figure 6B:
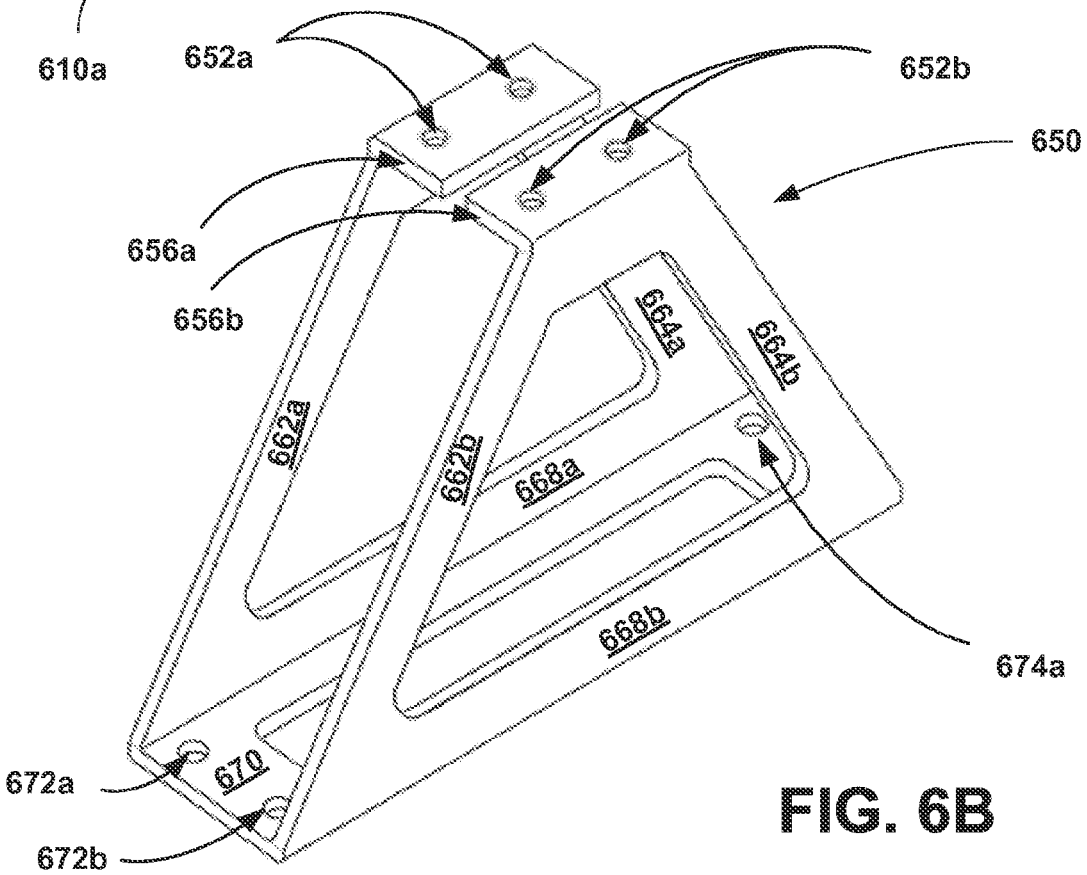

FIG. 6B illustrates a perspective view of an embodiment 650 of the internal support structure of the construction component of the invention that is similar to the embodiment 560 of FIG. 5B. Again, with respect to embodiment 612 of FIG. 6A, the primary difference is that the embodiment 650 of FIG. 6A is made from a single unitary piece. As is the case for embodiment 612*a*, embodiment 650 can be made from pressed sheet metal, and then bent to form base interface plate 670, as well as the two upper interface plates 656*a* and 656*b*, to form a triangular shape having a common base interface plate. Segments 662*a*, 664*a* and 668*a* form one of the triangles, and segments 662*b*, 664*b* and 668*b* form the second. Pairs of threaded openings 652*a* and 652*b* are formed in bent interface plate segments 656*a* and 656*b* respectively and configured to receive threaded bolts as in previously disclosed embodiments. Corresponding pairs of openings 672*a*, 674*a* and 672*b*, 674*b* (not shown) are formed in base interface plate segment 670 and are configured to receive threaded bolts as they are inserted into threaded openings 652*a* and 652*b* of staggered components as illustrated by previously disclosed embodiments.

Those of skill in the art will appreciate that construction components of the invention can be constructed with support structure 650 in the same manner as embodiments previously disclosed, by disposing the support structure 650 within a casting mold and pouring concrete therein to create a cast concrete block such that support structure 650 is nearly completely encapsulated by concrete. The top surface of each of the bent interface plate segments 656*a* and 656*b* (as well as threaded openings 652*a* and 652*b*) will be exposed at the top surface of the cast concrete block. Likewise, the bottom surface of the horizontal base interface plate segment 670 will be exposed at the bottom of the concrete block. Openings 672*a, b* and 674*a,b* are also made accessible from the top by forming vertical channels as part of the casting process (as described above for previously disclosed embodiments), to permit the insertion of threaded bolts through the openings 672*a, b* and 674*a, b* and into threaded openings 652*a* and/or 652*b* of the bent interface plate segments 656*a* and 656*b* of like staggered components as illustrated for previously disclosed embodiments. One vertical channel can be cast for each pair of the openings in the base interface segment 670, or two vertical channels can be cast for each one of the pair.

Figure 7:
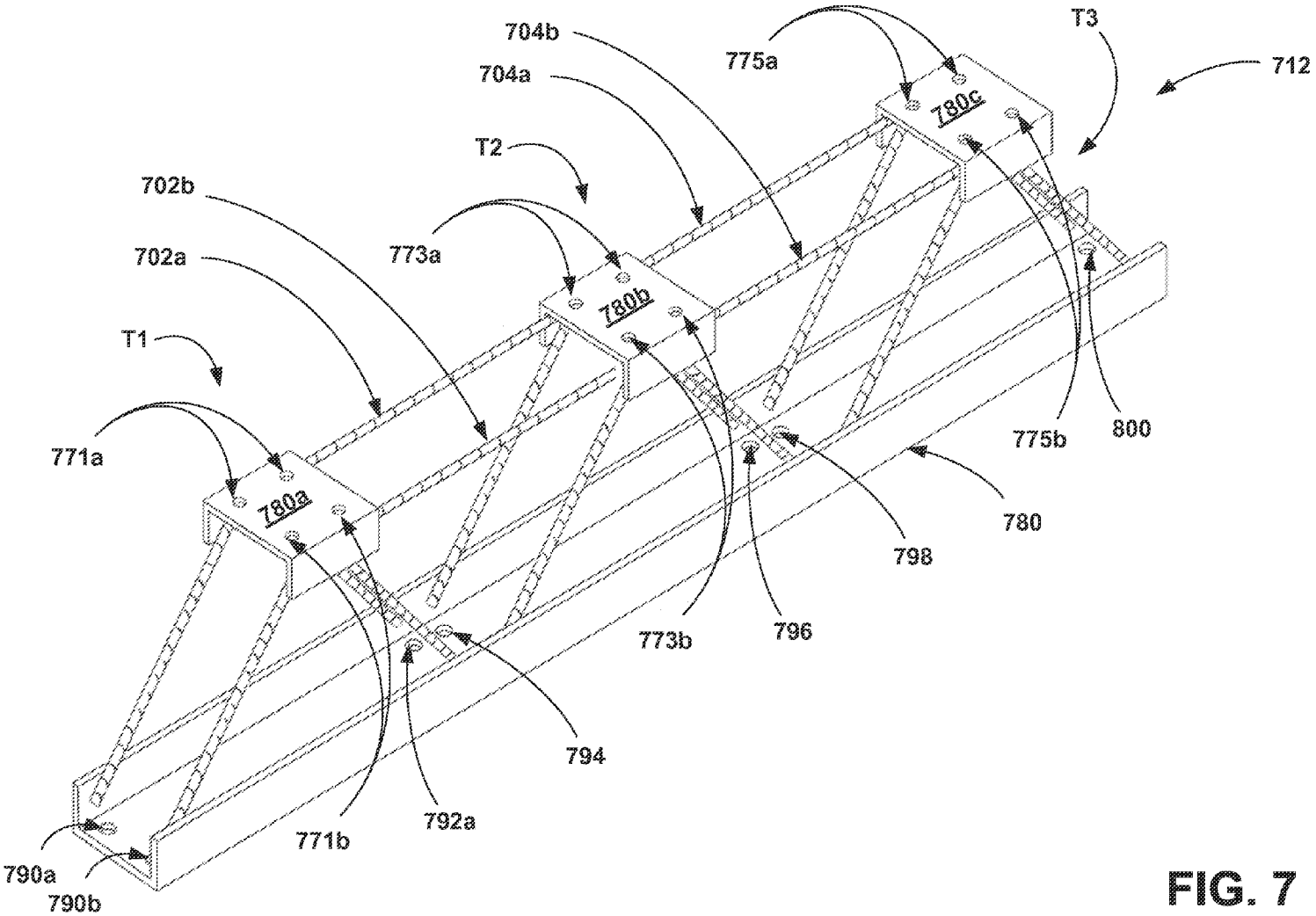
FIG. 7 illustrates a perspective view of an embodiment of the construction component of the invention employing a series of double triangular internal supports such as the embodiment of FIG. 5B, adapted to accommodate larger dimensions.

FIG. 7 illustrates a perspective view of an embodiment 712 of the internal support structure of the invention adapted to place multiple instantiations the embodiment 560 of FIG. 5B in series for building components of larger dimensions. As illustrated, the embodiment 560 of FIG. 5B has been repeated three times and the three individual instantiations are denoted T1, T2 and T3. In addition, triangles T1 and T2 are cross-coupled together by members 702*a* and 702*b* that are structurally fused between inverted U shaped interface plates 780*a* and 780*b* of triangular support structures T1 and T2 respectively. Triangles T2 and T3 are cross-coupled by members 704*a* and 704*b*, which are structurally fused to inverted U shaped interface plates 780*b* and 780*c* of triangular support structures T2 and T3 respectively. Each of the inverted U shaped interface plates 780*a*, 780*b* and 780*c* of instantiations T1, T2 and T3 have two sets of threaded openings 771*a, b*; 773*a, b*; and 775*a, b* as disclosed in FIG. 5B.

In embodiment 712, U-shaped base interface plate 780 is shared by all three instantiations of the triangular support structures T1, T2 and T3, but each instantiation has its own two sets of openings 790*a,b* and 792*a,b*; 794*a,b* and 796*a,b*; 798*a,b* and 800*a,b*. (Some of the openings are obscured by the view). Those of skill in the art will appreciate that providing a plurality of instantiations will permit constructions components of the invention that are, for example, multiples in length of a standard size. These can be useful whenever larger construction components may be preferable, such as when building eaves and overhangs.

Those of skill in the art will appreciate that construction components of the invention can be constructed with support structure 712 in the same manner as embodiments previously disclosed, by disposing the support structure 712 within a casting mold and pouring concrete therein to create a cast concrete block such that support structure 712 is nearly completely encapsulated by concrete. The top surface of each of the inverted U shaped interface plates 780*a*, 780*b* and 780*c* will be exposed at the top surface of the elongate cast concrete block, along with their respective sets of threaded openings 771*a, b* 773*a, b* and 775*a, b*. Likewise, the bottom surface of the U-shaped base interface plate 780 will be exposed at the bottom of the concrete block, along with openings 790*a, b* and 792*a, b*; 794*a, b* and 796*a, b*; 798*a, b* and 800*a, b*. The openings of base plate 780 are also made accessible from the top by forming vertical channels over each pair, over some combinations of pairs, or each individual opening (whichever is preferable) as part of the casting process. As described above for previously disclosed embodiments, the vertical channels can permit the insertion of threaded bolts through the openings 590*a, b* and 592*a, b* and into threaded openings of the inverted U-shaped interface plates 780*a, b*, and c of like sized building components, or smaller components of the invention in a staggered fashion as previously illustrated for other disclosed embodiments.

Figure 8:
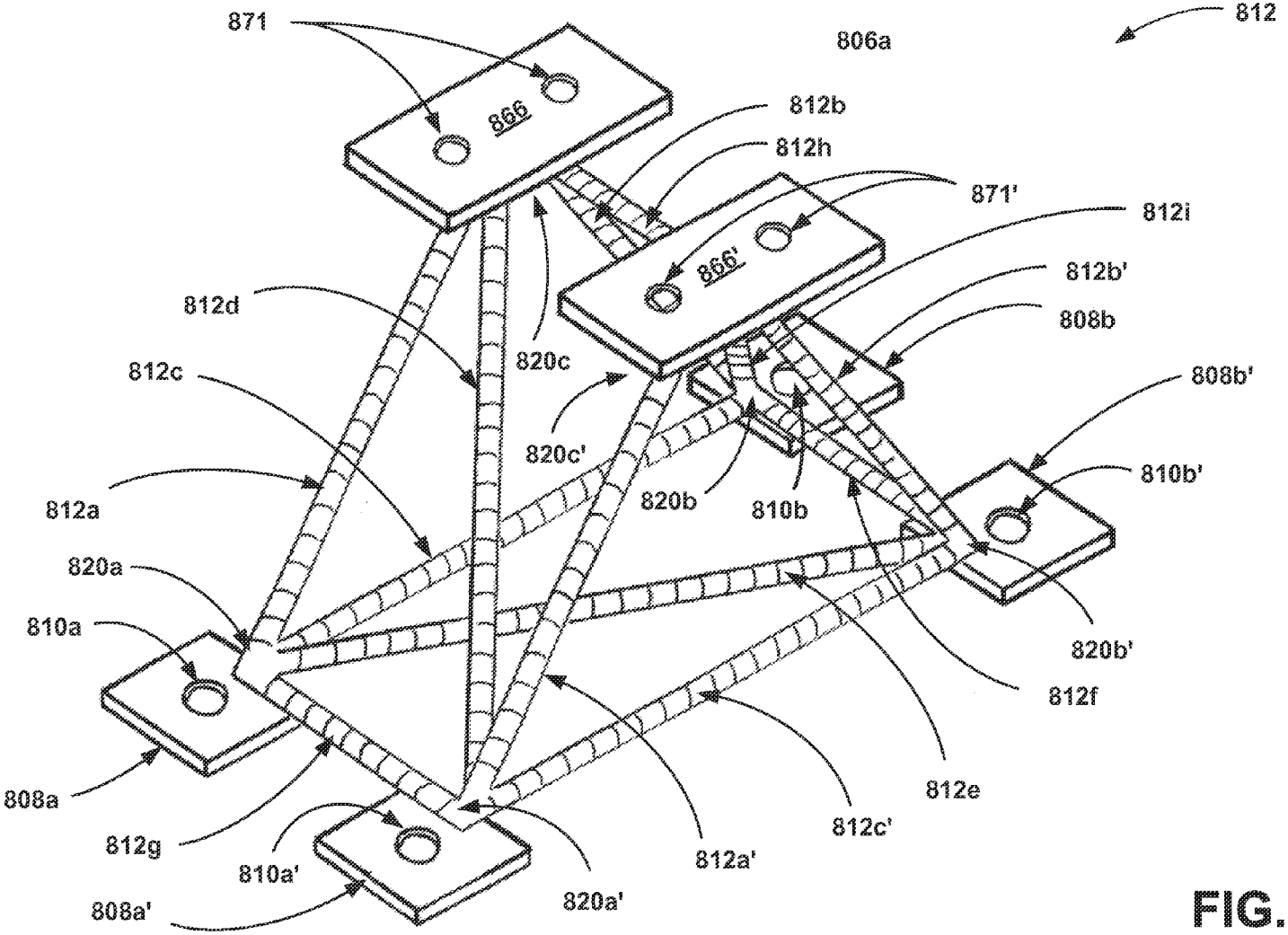
FIG. 8 illustrates a perspective view of an embodiment of the construction component of the invention having two cross-coupled triangular internal support structures.

FIG. 8 illustrates an embodiment 812 of an internal support structure of a building component of the invention that provides highly enhanced structural reinforcement of such a building component. Internal support structure 812 includes two isosceles triangles. One of the triangles is formed of members 812*a*, 812*b* and 812*c*, and the other is formed of members 812*a*', 812W and 812*c*'. The congruent members 812*a*, 812*b* and 812*a*', 812*b*' of each of the triangles is structurally fused with an upper interface plate 866 and 866' at its vertex opposite its base member. Upper interface plates 866 and 866' each include a pair of threaded openings 871 and 871' configured to receive threaded bolts as in previously disclosed embodiments. Each triangle is structurally fused to a pair of base interface plates 808*a, b* and 808*a*', b' at its base vertices 820*a*, 820*b* and 820*a*', 820*b*' respectively, each of which are opposite of its congruent members 812*a, b* and 812*a*', b' respectively. Each of the interface plates 808*a, b* and 808*a*', b' include a single opening 810*a, b* and 810*a*', b' respectively.

Additionally, embodiment 812 of the internal support structure of a building component of the invention includes additional reinforcing members that cross couple the two triangles to provide further structural reinforcement of a construction component in which it is incorporated. Member 812*f* is structurally fused between one end of base members

812*c* and 812*c*' at base vertices 820*b* and 820*b*' respectively. Likewise, member 812*g* is structurally fused between the opposite ends of base members 812*c* and 812*c*', at base vertices 820*a* and 820*a*'. Member 812*e* is structurally fused with base members 812*c* and 812*c*' diagonally at base vertices at 820*a* and 820*b*'. Members 812*e-f* therefore create additional cross-coupling between the bases of each of the triangles to provide even greater structural reinforcement perpendicularly and diagonally to the orientation of the base members 812*c* and 812*c*' of the triangles.

Further cross-coupling can be created from the upper vertex 820*c*, 820*c*' of each of the triangles, such as by member 812*d*, which is structurally fused between vertex 820*c* and base vertex 820*a*'. Member 812*i* (partially obscured) is structurally fused between upper vertex 820*c*' and base vertex 820*b*. Member 812*h* (partially obscured) is structurally fused between upper vertex 866 and upper vertex 866'. In the embodiment of FIG. 8, each of the six vertices of the double triangle are coupled to through four members to four other vertices.

It will be appreciated by those of skill in the art that cross-coupling each of the two triangles between their vertex and a base vertex of the other triangle creates a system of triangles that forms a support lattice within the construction component itself. This lattice reinforces the component against stress and tensional forces to create a very rigid structure that is particularly beneficial in withstanding seismic forces. The internal lattice created by this embodiment of the internal support structure can provide maximum strength with a minimal number of members.

Those of skill in the art will appreciate that construction components of the invention can be constructed with the embodiment 812 of the support structure of the invention in the same manner as embodiments previously disclosed, by disposing the support structure 812 within a casting mold and pouring concrete therein to create a cast concrete block such that support structure 812 is nearly completely encapsulated by concrete. The top surface of each of the interface plates 866 and 866' will be exposed at the top surface of the cast concrete block, along with their respective sets of threaded openings 871 and 871' respectively. Likewise, the base interface plates 808*a, b* and 808*a*', b' will be exposed at the bottom of the concrete block, along with openings 810*a, b* and 810*a*', b' respectively. The openings of base interface plates 810*a, b* and 810*a*', b' are also made accessible from the top of the cast concrete block by forming vertical channels over each opening as part of the casting process. As described above for previously disclosed embodiments, the vertical channels can permit the insertion of threaded bolts through the openings 810*a, b* and 810*a*', b' and into threaded openings 871 and 871' of the upper interface plates 866 and 866' of staggered and like-sized building components, as previously illustrated for other disclosed embodiments.

Figure 9:
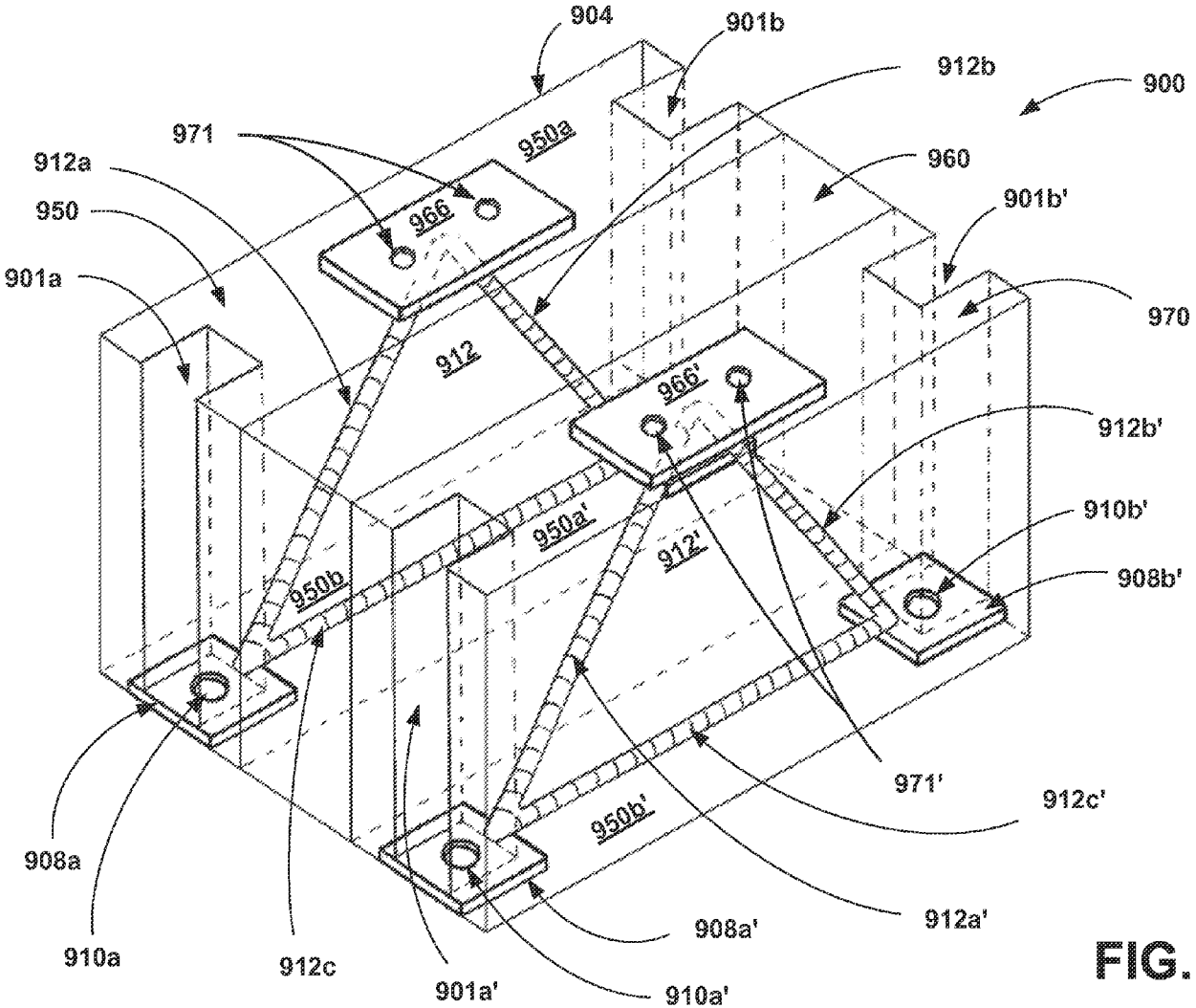
FIG. 9 illustrates a perspective view of an embodiment of the construction component of the invention having a thermal insulating layer embedded within the concrete cast block.

FIG. 9 illustrates a perspective view of an embodiment of the construction component 900 of the invention that is adapted to provide an embedded internal support structure for block that includes a thermal insulating section 960 located between two concrete sections 950 and 970. Prior art building components that employ such thermal layers tend to be bulky, as the insulation layer is commonly 3-5 inches thick. Moreover, without embedded support structures that can be mechanically coupled together during construction as previously described with respect to other embodiments disclosed herein, there is no reinforcement to keep the two concrete sections on either side together. Thus, building structures using the prior art blocks typically requires the addition of steel rebar during wall construction, which are disposed in the layer of mortar that is laid between the blocks. These thin members of rebar are typically added into the mortar running from one concrete section the other.

These members of steel rebar are typically wires with the ends bent at 90 degrees. They are typically placed about every 5 inches or so within the mortar bed, and added manually by the mason. While this technique can provide satisfactory structural reinforcement, there numerous disadvantages to such known practices, including the fact that requiring skilled masons to manually add the reinforcement members makes the process highly labor intensive and therefore expensive. Moreover, the added members of rebar provide strong thermal connectivity between the inside and outside concrete sections, thereby defeating the benefits of the thermal layer by creating short-circuits of high thermal connectivity therebetween.

In the embodiment of FIG. 9, each of the concrete sections are virtually identical to the embodiment 100 illustrated in FIGS. 1 and 2 described above. Each concrete section has a single triangular structure 912, 912' embedded therein, each composed of two congruent members 912*a, b* and 912*a', b*' and base members 912*c*, 912*c*' respectively. Each internal triangular support structure 912, 912' includes a pair of base interface plates 908*a, b* and 908*a*', b' that are exposed through the lower surfaces 950*b* and 950*b*' of the cast concrete sections in which they are embedded, respectively. Each internal triangular support structure 912, 912' further includes an upper interface plate 966, 966' having threaded openings 971, 971' that are exposed through the top surface 950*a*, 950*a*' of the cast concrete sections 950, 970 in which they are embedded, respectively. Finally, each pair of base interface plates 908*a, b* and 908*a*', b' has openings 910*a, b* and 910*a*', b' therethrough, which are made accessible from above through vertical channels 901*a, b* and 901*a', b*' respectively.

The size and material of the thermal insulating layer 960 can be varied to achieve different R values as desirable. Thermal insulating layer 960 can be made from, for example, extruded polystyrene foam. The concrete structures 950 and 970 can be made of, for example, concrete with expanded-clay aggregate filler, and an exterior layer of component 900 can be made of air-entrained concrete. It will also be appreciated that the internal support structures 912 and 912' are disposed in the concrete sections to ensure rigidity of the lattice created by the connected support structures when the components are used in building a structure such as a wall as described above for other embodiments.

Figure 10:
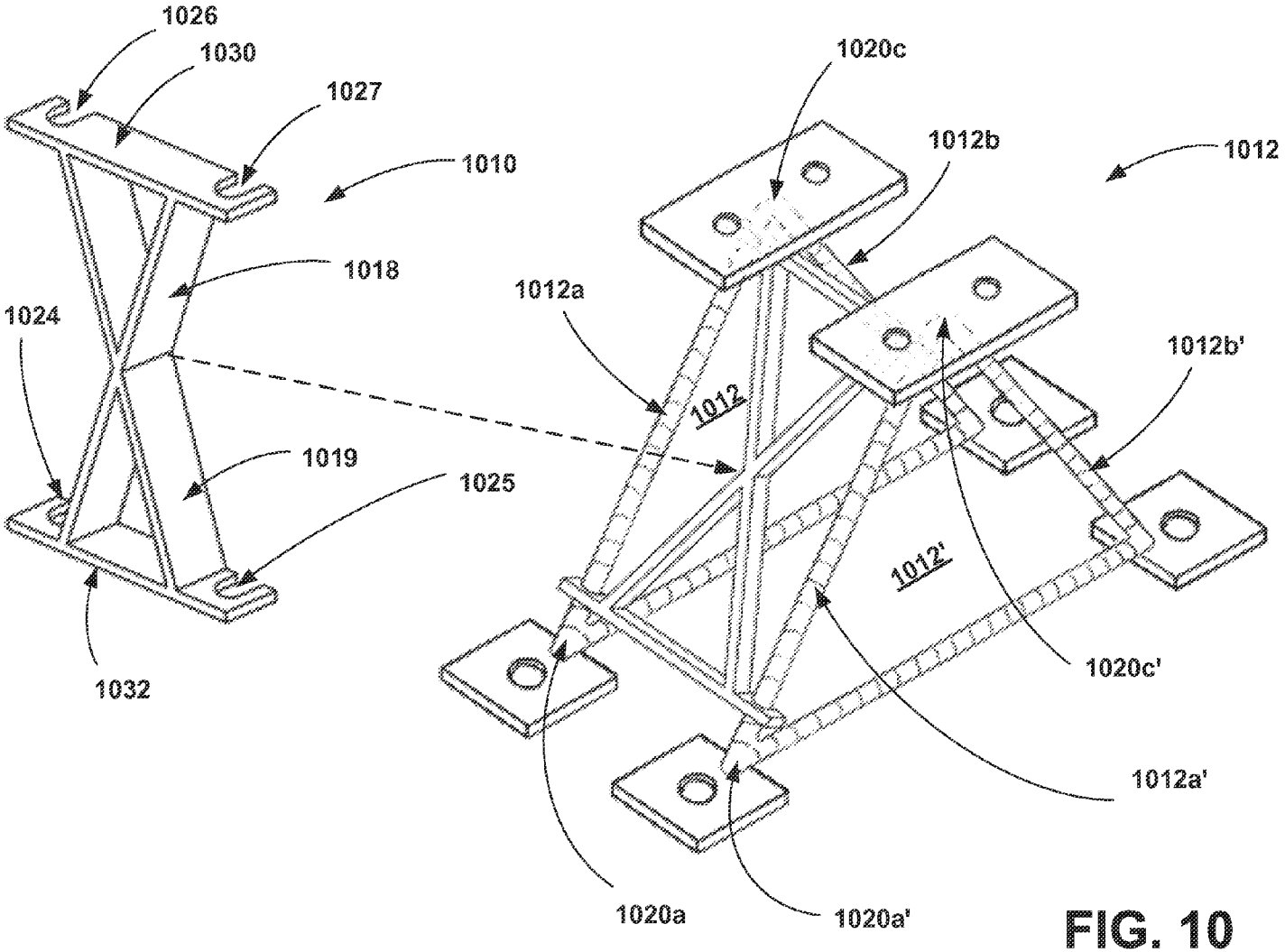
FIG. 10 illustrates a perspective view of an embodiment of the internal support structure of the construction component of FIG. 9, where the two triangular structures that are coupled through a coupling component that has low thermal conductivity.

FIG. 10 illustrates an alternate embodiment 1012 of a cross-coupled internal support structure similar to that of FIG. 9. The embodiment of FIG. 10 provides the additional advantage of cross-coupling the internal triangular structures 1012 and 1012' by attaching cross-coupling component 1010 as illustrated, which will be disposed at least partially, within the thermal section 960 of the construction component 900 of FIG. 9. Those of skill in the art will appreciate that the cross-coupling component 1010 can be composed of a unitary piece of pressed material, such as a rigid plastic, resin or fiberglass, that has suitable rigidity and strength to provide the desired mechanical cross-coupling reinforcement between the two embedded structures, yet has very low thermal conduction such that the embedded support structures can be mechanically cross-coupled while ensuring minimal thermal coupling therebetween.

Cross-coupling component 1010 has cross-coupled members 1018 and 1019 that terminate at upper coupling member 1030 and lower coupling member 1032. Upper 1030 and lower 1032 coupling members include rounded notches 1026, 1027 and 1024, 1025 respectively for receiving congruent members off the triangular support structures 1012 and 1012' as illustrated. Thus, a cross-coupling component 1010 can be coupled to the triangular structures 1012 and 1012' such that notches 1026 and 1024 receive member 1012*a* at just below vertex 1020*c* and just above vertex 1020*a* respectively of 1012, and notches 1027 and 1025 receive member 1012*a'* just below vertex 1020*c'* and just above 1020*a'* respectively. The notches can provide one way to permit the mechanical coupling between the cross-coupling component 1010 and the support structures through deformation, because they are made of disparate materials that do not permit them to be structurally fused. Likewise, another cross-coupling component can be disposed at the opposite end (not shown) of the two triangular structures 1012 and 1012' by which to cross-couple congruent members 1012*b* and 1012*b'* together.

Those of skill in the art will appreciate that further embodiments of the construction element of the invention are possible based on the foregoing disclosure. For example, as previously discussed with respect to the embodiment of FIG. 7, varying sizes of the construction elements are possible by providing multiple instantiations of the embedded internal support structures 112, 512, 560, 612, 650, 812, 912 and 1012, horizontally as shown in FIG. 7 or even vertically, in the form of single larger pre-manufactured block. These larger sized blocks can be particularly useful for minimizing the number of construction components required for wall construction, or for application over windows or door openings in walls. Moreover, while preferred embodiments of the internal support structures are shown herein to have congruent members coupled to a base member to form an isosceles triangle, non-congruent members could be used without exceeding the intended scope of the invention disclosed herein. For example, a non-rectangular block might be better served by an internal structure having non-congruent members coupled to a base member.

Other embodiments of the construction block of the invention can include providing decorative features on the outer surfaces of the cast blocks. In addition, the outer surfaces of the construction component can be pre-treated during manufacture with water resistant coatings, siding, paint, layers of bonding material, as well as other technological or decorative treatments on the outer surfaces.

In further embodiments, the construction component of the invention can be manufactured with one or more layers of different filler materials in addition to the cast concrete.

In another embodiment, the construction component of the invention can be marked on the outer surfaces of the cast concrete with marks, signs, and coding, that can be read by machines for purposes of automating construction system.

As previously discussed, while the previously disclosed embodiments are shown with coupling between the interface plates as being accomplished through threaded bolts and threaded openings in the upper interface plates located at the vertex of the triangular support structure that is opposite its base, it will be appreciated by those of skill in the art that other means of fastening the construction components of the invention at their interface plates may be accomplished by other suitable means, such as structurally fusing them by welding, or by riveting them together.

Further embodiments may add additional vertical hollow channels during the manufacturing process that can be located, for example, at locations that are 25% of the length of the block from each end. When the construction components of the invention are mechanically joined in building a structure such as a wall, these hollow channels will line up as the components are staggered to provide continuous void spaces within the structure for purposes of running wiring, plumbing, and the like.

Thus, it will be appreciated by those of skill in the art that numerous benefits will be realized through construction using the various embodiments of the construction component of the invention. For example, by incorporating structural reinforcement during the manufacturing process, rather than adding it on site, the structural reinforcement components are added as part of a controlled manufacturing process in a controlled manufacturing environment, thereby increasing quality and consistency of such components. Further, by eliminating the need for such reinforcement to be performed by skilled labor on site during construction, the cost and time of construction is significantly reduced.

Additionally, the uniform reinforcement lattice that is established throughout a structure, formed by the internal support structures of the construction components as they are coupled together during construction, provides a high ratio of strength per amount of reinforcement material used. Thus, the amount of reinforcement materials deployed can be minimized for a desired strength of reinforcement, or put another way, reinforcement is maximized for a specified cost of reinforcement material.

Maximizing strength of reinforcement can be of particular importance in areas of high seismic activity. Those of skill in the art will appreciate that concrete is known to have good stress properties, but has low tension strength. This makes concrete vulnerable to catastrophic failure during high seismic activity. Thus, containment of the cast concrete within the reinforcement lattice created by the construction components of the invention as previously described, reduces the likelihood of catastrophic failure when subjected to such seismic activity.

Further, because a regular and uniform lattice-like reinforcement structure has demonstrated robust strength based on assessment models, the use of the construction components of the invention increases reliability of calculations used to determine the amount of reinforcement strength attainable for a given level of reinforcement materials to be used, the cost of custom design is reduced because the required guard-band to ensure that a given specification is met is narrower. Indeed, with the reinforcement structure contained within the construction component, it can be much more easily and accurately stress tested in a laboratory setting.

It will be appreciated that the ability to fabricate construction components with structural reinforcement built into standardized sizes and shapes ultimately reduces the cost of constructing custom designs, and lowers overall fabrication costs of the construction components themselves. This also permits easy scaling of such components to any practicable size.

What is claimed is:

1. A construction component having embedded internal structural reinforcement, the internal structural reinforcement configured to be directly coupled to the internal reinforcement of others of said construction component, said construction component comprising:

an internal support structure, the support structure including:

at least one triangular structure, the at least one triangular structure formed of a base member and two congruent side members to form a first base vertex between a first one of the congruent members and the base member, a second base vertex between the second congruent member and the base member, and an elevated vertex formed by the first and second congruent members opposite of the base member;

at least one elevated interface plate, structurally coupled to the at least one triangular structure substantially at the elevated vertex; and a first and a second base interface plate, the first base interface plate coupled to the at least one triangular structure substantially at the first base vertex, and the second base interface plate coupled to the at least one triangular structure substantially at the second base vertex; and a cast concrete block substantially encapsulating the internal support structure therein, wherein the elevated interface plate of the internal support structure is exposed through a top surface of the concrete block, and the first and second base interface plates are exposed through a bottom surface of the concrete block, and wherein the elevated interface plate of the construction component is configured to be mechanically coupled to one of the base interface plates of each of at least two others of said construction component to securely couple said construction components together in a staggered manner.

2. The construction component of claim 1, wherein the congruent members and base member of the at least one triangular structure are composed of steel rebar.

3. The construction component of claim 1 wherein the at least one triangular structure is composed of a unitary piece of pressed metal.

4. The construction component of claim 3 wherein the upper and base interface plates are bent to form right angles to the two congruent and base members respectively.

5. The construction component of claim 1 wherein the cast concrete block includes at least a first and second vertical channel, each extending from the top surface to the bottom surface of the concrete block, and disposed over the base interface plates to provide access to the base interface plates from the top surface to facilitate mechanical coupling of each of the exposed base interface plates to the elevated interface plates of others of said construction components.

6. The construction component of claim 5, wherein each of the base interface plates include at least one opening therethrough, each of the vertical channels disposed directly over the at least one opening of each of the base interface plates.

7. The construction component of claim 6 wherein the upper interface plate includes at least two threaded openings, wherein the at least one opening of each of the base interface plates of a first one of said construction components is configured to be aligned with at least one of the at least two threaded openings of the elevated interface plate of a second one of said construction components such that a threaded bolt can be inserted through the at least one opening of the base interface plate and screwed into the at least one of the at least two threaded bolts to mechanically couple the first one and second one of said construction components together.

8. The construction component of claim 7 wherein a third one of said construction components can be coupled in a staggered manner to the second one of said construction components along with the first one of said construction components by screwing a threaded bolt through the at least one opening of the third one of said construction components into a remaining at least one of the at least two threaded openings of the elevated interface plate of said second one of the construction components.

9. The construction component of claim 5, wherein a first one of said construction components can be mechanically coupled to a second one of said construction components by riveting the base plate of said first construction component to the elevated interface plate of the second interface component through the vertical channel of said first construction component.

10. The construction component of claim 5, wherein a first one of said construction components can be mechanically coupled to a second one of said construction components by welding the base plate of said first construction component to the elevated interface plate of said second interface component through the vertical channel of said first construction component.

11. The construction component of claim 5 wherein the first and second base plates are formed a single L-shaped bar.

12. The construction component of claim 5 wherein the internal support structure includes two of the triangular structures disposed substantially in parallel with one another, and the concrete block includes at least a first and second vertical channel disposed over the base interface plates of each of the two triangular structures.

13. The construction component of claim 12, wherein the first and second base plates of each of the two triangular structures are formed of a single U-shaped bar.

14. The construction component of claim 13, wherein the internal support structure includes two or more instantiations of the two triangular structures disposed in parallel, each of the instantiations including additional members that are coupled between the elevated vertices of the two or more instantiations.

15. The construction component of claim 12, wherein the internal support structure further includes one or more additional members that are cross-coupled between the base vertices of the two triangular structures.

16. The construction component of claim 15 wherein the internal support structure further includes one or more additional members that are cross-coupled between the elevated vertex of at least one of the two triangular structures to at least one of the base vertices of the other of the two triangular structures of the internal support structure.

17. The construction component of claim 1, wherein the at least one triangular structure further includes:

a vertical member extending from the upper vertex to a point on the base member that is substantially half way between the two base vertices; and a support plate that is structurally coupled to the triangular structure at a point beneath the intersection between the vertical member and the base member.

18. The construction component of claim 1 wherein the cast concrete block has the dimensions of a CMU (concrete masonry unit).

19. The construction component of claim 1, wherein constructing a structure from a plurality of said construction components creates an interconnected internal lattice-like support structure throughout the constructed structure.

20. A construction component having embedded internal structural reinforcement, the internal structural reinforcement configured to be directly coupled to the internal reinforcement of others of said construction component, said construction component comprising:

an internal support structure, the support structure including:

at least two triangular structures, the at least two triangular structures each being formed of a base member and two congruent side members to establish a first base vertex between a first one of the congruent members and the base member, a second base vertex between the second congruent member and the base member, an elevated vertex formed by the first and second congruent members opposite of the base member, and at least one member cross-coupled between a first and second one of the at least two triangular structures;

at least one elevated interface plate being structurally coupled substantially at the elevated vertex of each of the at least two triangular structures; and at least one first and at least one second base interface plate, the at least one first base interface plate being coupled substantially at the first base vertex of each of the at least two triangular structures, and the at least one second base interface plate being coupled substantially at the second base vertex of each of the at least two triangular structures; and a cast concrete block substantially encapsulating the internal support structure therein, the at least one elevated interface plate of the internal support structure being exposed through a top surface of the concrete block, the at least one first and the at least one of the second base interface plates being exposed through a bottom surface of the concrete block, and wherein the at least one elevated interface plate of said construction component is configured to be mechanically coupled to one of the at least one base interface plates of each of at least two others of said construction component to securely couple said construction components together in a staggered manner.

21. The construction component of claim 20, wherein the first and second of the at least two triangular structures are disposed in planes that are substantially in parallel with one another.

22. The construction component of claim 20, wherein the at least one cross-coupled member is coupled substantially between the vertex of each of the first and second ones of the at least two triangular structures.

23. The construction component of claim 20, wherein the cross-coupled member is coupled substantially between the vertex of the first one of the at least two triangular structures and at least one of the two base vertices of the second one of the at least two triangular structures.

24. The construction component of claim 20, wherein the at least one cross-coupled member is coupled substantially between at least one of the base vertices of the first one of the at least two triangular structures, and at least one of the two base vertices of the second one of the at least two triangular structures.

25. The construction component of claim 20, wherein:

the concrete block includes a thermally resistant layer that substantially divides the concrete block into at least two substantially discrete concrete sections, and the first and second of the at least two triangular structures are each encapsulated within a different one of the concrete sections.

26. The construction component of claim 25, wherein the at least one cross-coupled member is part of a cross-coupling component that is coupled substantially between the first congruent members of each of the first and second ones of the at least two triangular structures to provide cross-coupling between the upper vertex of the first one of the at least two triangular structures and the first base vertex of the second one of the at least two triangular structures, and vice versa.

27. The construction component of claim 26, wherein the cross-coupling component further includes members that provide cross-coupling between the upper vertices of the first and second ones of the at least two triangular structures, and between each of the first base vertices of the first and second ones.

28. The construction component of claim 27, wherein the at least one cross-coupled member spans the thermally resistant layer of the block between the first and second ones of the at least two triangular structures.

29. The construction component of claim 28, wherein:

the base member and two congruent side members of the first and second ones of the at least two triangular structures are made of thermally conductive metal, and the cross-coupled member is made of a thermally resistant material.

30. The construction component of claim 20 wherein the cast concrete block includes at least a first and second vertical channel, each extending from the top surface to the bottom surface of the concrete block, and disposed over the base interface plates to provide access to the base interface plates from the top surface to facilitate mechanical coupling of each of the exposed base interface plates to the elevated interface plates of others of said construction components.

* * * * *